US008444781B1

(12) United States Patent
Anderson

(10) Patent No.: US 8,444,781 B1
(45) Date of Patent: May 21, 2013

(54) METHOD OF STRENGTHENING METAL PARTS THROUGH AUSIZING

(75) Inventor: Gary L. Anderson, St. Marys, PA (US)

(73) Assignee: Keystone Investment Corporation, Wilmington, DE (US)

( * ) Notice: Subject to any disclaimer, the term of this patent is extended or adjusted under 35 U.S.C. 154(b) by 786 days.

(21) Appl. No.: 11/820,137

(22) Filed: Jun. 18, 2007

Related U.S. Application Data

(60) Provisional application No. 60/815,225, filed on Jun. 20, 2006.

(51) Int. Cl.
*C21D 9/00* (2006.01)

(52) U.S. Cl.
USPC ..... 148/559; 148/586

(58) Field of Classification Search
USPC ..... 419/31, 25; 148/586, 559; 29/893.32
See application file for complete search history.

(56) References Cited

U.S. PATENT DOCUMENTS

| | | | | |
|---|---|---|---|---|
| 2,079,513 | A * | 5/1937 | Lapsley | 29/893.32 |
| 5,221,513 | A | 6/1993 | Amateau et al. | 266/81 |
| 5,391,862 | A | 2/1995 | Amateau et al. | 219/667 |
| 5,451,275 | A | 9/1995 | Amateau et al. | 148/573 |
| 5,656,106 | A | 8/1997 | Amateau et al. | 148/586 |
| 5,711,187 | A | 1/1998 | Cole et al. | 74/434 |
| 5,799,398 | A | 9/1998 | Amateau et al. | 29/893.32 |
| 6,007,762 | A | 12/1999 | Amateau et al. | 266/118 |
| 6,126,892 | A | 10/2000 | Amateau et al. | 266/118 |
| 6,264,768 | B1 | 7/2001 | Sonti et al. | 148/567 |
| 6,630,101 | B2 * | 10/2003 | Anderson et al. | 419/25 |
| 2004/0219051 | A1 * | 11/2004 | Sonti et al. | 419/31 |

* cited by examiner

*Primary Examiner* — Weiping Zhu
(74) *Attorney, Agent, or Firm* — Alvin T. Rockhill

(57) ABSTRACT

The subject invention discloses a process for strengthening and obtaining the desired dimensions for a metal part comprising: (1) heating at least a portion of a preformed metal part to a temperature above about 1300° F. to transform the metal in at least said portion of the part to an austenitic state to produce an austenitized preformed metal part, (2) quenching the austenitized preformed metal part to a temperature of 300° F. to 650° F. to put the metal in the preformed part in a metastable austenitic state, (3) coining, drawing or extruding the preformed metal part while said metal of said preformed metal part is maintained in the metastable austenitic state at a temperature of 300° F. to 650° F., and (4) quenching the coined, drawn, or extruded metal part at a temperature which allows for the rapid transformation from austenite to martensite.

12 Claims, 3 Drawing Sheets

METHOD OF STRENGTHENING METAL PARTS THROUGH AUSIZING

This application claims the benefit of U.S. Provisional Patent Application Ser. No. 60/815,225, filed on Jun. 20, 2006, and incorporates the teachings thereof herein by reference in their entirety.

FIELD OF THE INVENTION

This invention relates to the coining, drawing or extruding of metal articles, such as parts including, but not limited to gears, cams, bearing races, bearing guides, parking gear guides, clutch races, and the like, while the article is held at a temperature which is in the metastable austenitic state.

BACKGROUND OF THE INVENTION

Powder metal parts are currently being used in a wide variety of high volume applications due to their substantially lower costs. However, because of current strength limitations of powder metal components, applications in vehicle power transmissions have been limited only to lower-loaded components. Although powder metal gears are increasingly being used in powered hand tools, gear pumps, and as accessory components in automotive transmissions, powder metal gears have not been used for power transmission gearing. The state-of-the-art powder metal gears do not possess adequate tooth bending strength and pitting/wear resistance as compared to gears produced from wrought and/or forged steels.

Highly loaded gears used for power transmission gearing are conventionally manufactured from wrought and/or forged low carbon, low to medium alloyed steel blanks. After preliminary blank machining, gear teeth are produced by metal cutting operations such as hobbing or shaping, or by forging to near net shape. Gears are then heat treated to impart desired surface strength, strength gradient and core toughness. Heat treatment involves carburizing the surface of low carbon steel gears to increase the surface and near surface carbon content, followed by hardening by rapid quenching to below the temperature ($M_s$) at which a diffusionless transformation process that creates a hardened martensitic structure proceeds to completion. Alternatively, gear wheels produced from medium to high carbon alloy steel compositions, which therefore do not need carburization, are instead induction hardened, wherein only the gear tooth surfaces are heated and then quenched to produce the hardened martensitic structure. The hardened gears are then finished to net shape by grinding, skiving, burnishing, and/or honing operations.

For powder metal gears, a method has been described in U.S. Pat. No. 5,711,187, wherein a powder metal gear wheel formed from a pressed and sintered powder metal blank is claimed to be surface hardened by densifying the tooth surface layers, both in the flank and root/fillet region. This patent describes a pre-finishing technique of gear rolling that is performed prior to heat treatment and hardening using either a single-die or double-die rolling apparatus, and is applicable for sintered low alloy steel compositions similar to SAE 4100, SAE 4600, and SAE 8600 grades. However, as the method described in U.S. Pat. No. 5,711,187 is a pre-finishing operation that is performed prior to heat treatment and hardening, it is applicable only to low carbon low alloy sintered steel compositions in the soft machinable condition, particularly compositions with carbon contents of 0.2% or less. This patent claims full theoretical densification at the rolled surfaces and a progressively decreasing densification (90-100%) gradient of at least 380 microns up to about 1000 microns in depth.

As noted above, the method described in U.S. Pat. No. 5,711,187 is applicable only to relatively soft gear wheel blanks made of low carbon low alloy sintered powder metal steel compositions with hardness typically less than BHN 180 (or HRC less than 24). Gear rolling of soft sintered gear tooth surfaces as described in U.S. Pat. No. 5,711,187 produces densification of tooth surface layers. As has been noted above, powder metal gears, either in the as-sintered condition or after surface densification by gear rolling as described in this patent, have to be heat treated by carburizing and hardening operations to achieve the specific surface hardness, hardness gradient and core strength necessary for high load bearing power transmission gearing. Any surface hardening achieved due to work hardening by gear rolling and related surface densification as described in U.S. Pat. No. 5,711,187 is substantially eliminated during the subsequent heat treatment process.

Furthermore, because the sintered and densified powder metal gears produced by the method described in U.S. Pat. No. 5,711,187 are subjected to heat treatment and hardening, the gears may require subsequent hard finishing by grinding, skiving, burnishing or honing operations to achieve the required level of accuracy, resulting in removal of about 150 microns of the densified surface region of gear teeth. This removal of the portion of the surface region with improved apparent hardness of powder metal densified surface layers lowers the load bearing capacity.

Apparatus and methods have been described in U.S. Pat. No. 5,221,513; U.S. Pat. No. 5,391,862; U.S. Pat. No. 5,451,275; U.S. Pat. No. 5,656,106; U.S. Pat. No. 5,799,398; U.S. Pat. No. 6,007,762; and U.S. Pat. No. 6,126,892 for wrought and/or forged steel gear wheels and U.S. Pat. No. 6,264,768 for rolling element bearings in which a carburized and hardened workpiece is finished by thermomechanical means by inducing controlled plastic deformation in the metastable austenitic condition via gear rolling. Such a thermomechanical treatment, also called ausform finishing, of hardened gear tooth surfaces involves reaustenitization by induction heating followed by marquenching at about 450° F. to 500° F. or above the start of the martensite transformation temperature ($M_s$). The gear teeth in this marquenched condition are roll finished and then finally quenched to martensite before any diffusional decomposition can form from the metastable austenite. For wrought and/or forged gear wheels, the thermomechanical method of ausform finishing described in the above-identified patents results in substantial material flow up and down the tooth surfaces and in the axial direction due to combined rolling and sliding action on the tooth surfaces. Unlike conventional gear finishing such as grinding, the outermost surface hardened layers are not removed during the ausform finishing operation.

The method described in the previously mentioned patents is also applicable to medium to high carbon alloyed gear steels, wherein the carbon content is sufficiently high such that the carburizing operation is not required. The thermomechanical procedure described in the patents is thus applicable to both low carbon carburized/hardened gear steels as well as medium to high carbon induction hardenable gear steels and is employed in the present invention.

United States Patent Application Publication No. 2004/0219051 discloses a technique wherein sintered and hardened gear wheels are surface densified, hardened, strengthened, and finished to high accuracy by thermomechanical means in the metastable austenitic condition. This simultaneously occurs in the gear tooth flanks and in the root/fillet regions by substantial surface compaction during the rolling operation.

In accordance with United States Patent Application Publication No. 2004/0219051 there is provided a method and apparatus for densification by surface compaction and roll finishing of sintered and hardened powder metal gear wheels by thermomechanical means in the metastable austenitic condition, both on the flanks and in the root/fillet regions of gear teeth, resulting in surface densification to fully dense at the surface and 95-100% in the near surface region. This produces enhanced apparent surface and near surface hardness, improves mechanical properties due to ausforming, and produces a dimensional accuracy and surface finish comparable to or better than hard grinding, thereby eliminating the need for any subsequent finishing operations. The method described by United States Patent Application Publication No. 2004/0219051 is reported to be applicable to both sintered low carbon alloy powder metal gear steels that are carburized and hardened prior to the thermomechanical finishing treatment, and to sintered medium to high carbon alloy powder metal gear steels that are induction hardenable.

The method described by United States Patent Application Publication No. 2004/0219051 for sintered and hardened powder metal gears is reported to result in surface densification to 100% theoretical density at the surface, with progressively reducing densification of 95 to 100% produced at least in the outer 400 microns, and possibly up to 1300 microns. Furthermore, as the procedure of United States Patent Application Publication No. 2004/0219051 is the final finishing operation for hardened powder metal gears, the full benefit of the surface densification achieved and the related enhanced apparent surface hardness, finished gear strength, accuracy and surface finish, are fully retained. Finally, the plastic deformation induced in the metastable austenitic condition by thermomechanical means induces additional strength due to ausforming effects, thus resulting in further enhanced strength of the gear wheels.

As the powder metal sintered and heat treated gear wheels contain substantial amounts of pores prior to densification with effective density in the range of 90-95% of theoretically fully dense alloy, the rolling dies used for thermomechanical finishing are required to be designed specifically for densification by rolling involving substantial compaction of the material in the tooth surface layers. In contrast, the rolling dies for thermomechanical finishing of gear wheels made of wrought or forged steels are designed for combined rolling and sliding action on the tooth surface layers. The material flow is lateral oriented both in the tangential direction up and down the gear teeth as well as in the axial direction as no radial compaction of the material is possible. Therefore, for the thermomechanical finishing of powder metal sintered and heat treated gear wheels, the rolling dies apply surface densification pressure resulting in a collapse of the pores near the tooth surface region. This results in densification. The shapes of the rolling die, especially the die tooth tips, are designed for conjugacy, for contacting the gear wheel in the regions of interest and for compressing the material.

In order to achieve a nominally involute rolled gear wheel tooth profile in the finished condition for sintered and hardened powder metal steel gears, the rolling dies' tooth profile must substantially deviate from nominal involute tooth geometry. As the method of United States Patent Application Publication No. 2004/0219051 involves induction heating of the gear tooth surfaces followed by marquenching to temperatures in the range of 450° F. to 500° F. and then plastic deformation and compaction of surface layers by gear rolling, the rolling dies are maintained at the processing temperature of 450° F. to 500° F. and therefore are subjected to substantial thermal expansion. Due to the rolling die thermal expansion, the die tooth profile at the elevated operating temperature is substantially different from the initial rolling die tooth profile at room temperature and as originally produced. Similarly, the gear is not only roll finished at the elevated temperature of 450° F. to 500° F., but is also subjected to localized heating of the surface layers by induction heating followed by marquenching.

United States Patent Application Publication No. 2004/0219051 describes a procedure wherein the gear is thus subjected to a complex thermal history as well as associated metallurgical transformations. The resulting volumetric dimensional changes in the gear tooth profiles thus result in substantial deviation from the initial gear tooth profiles at room temperature and as originally produced. The gear teeth in the thermally and metallurgically modified geometrical shape and state are then rolled against the thermally modified rolling dies under high loads and speeds. The gear teeth are thus subjected to plastic deformation and densification at the elevated temperature by rolling pressure applied by the thermally modified rolling dies.

The roll finished and densified gear, still at the elevated temperature, is then finally quenched to room temperature and/or further below the $M_f$ temperature. It is in the finally quenched condition that the sintered, hardened and rolled/densified gear wheel is in conformance with the specified nominally involute gear geometry condition. Predicting and implementing the required initial specialized rolling die tooth profile is critical for achieving the desired contact along the gear wheel tooth surfaces and the desired degree of compaction and densification in the flank and root/fillet regions of the gear teeth.

In order to produce wrought or forged steel gears with improved accuracy, surface finish and enhanced load carrying capacity, United States Patent Application Publication No. 2004/0219051 notes that the gear roll finishing process must be applied to both the active contacting surfaces as well as the trochoidal root fillet regions of the helical gear teeth. The apparatus and methods to this end have been disclosed in U.S. patent application Ser. No. 10/056,928 of Nagesh Sonti et al. As therein explained, if the roll finishing operation were extended to finish the root/fillet regions in addition to the active contacting surfaces of the gear teeth, then the surface finish and bending fatigue strength of the gear teeth would be substantially improved. Root fillet regions of gear teeth experience the maximum bending stress. Roll finishing of the root/fillet regions improves the surface finish, thereby reducing the stress concentration, and enhances the fatigue resistance of the material due to plastic working.

United Stated Patent Application Publication No. 2004/0219051 A1 more specifically discloses a method for net shaping gear teeth of a high performance power transmission gear from a powder metal workpiece, comprising the steps of: (a) heating a powder metal workpiece in the form of a near net shaped gear blank having gear teeth surfaces above its critical temperature to obtain an austenitic structure throughout its surfaces; (b) isothermally quenching the workpiece at a rate greater than the critical cooling rate of its surfaces to a uniform metastable austenitic temperature just above the martensitic transformation temperature; (c) rolling the gear teeth surfaces of the workpiece to a desired outer peripheral profiled shape between opposed dies, each die having an outer peripheral profiled surface, while holding the workpiece at the uniform metastable austenitic temperature, the gear teeth surfaces undergoing densification, plastic deformation, and strengthening as a result of the rolling operation; and (d)

cooling the workpiece through the martensitic range to thereby harden the surfaces of the gear teeth.

United Stated Patent Application Publication No. 2004/0219051 A1 further discloses an apparatus for net shaping gear teeth of a high performance power transmission gear from a powder metal workpiece comprising: a source of heat for heating a powder metal workpiece in the form of a near net shaped gear blank having carburized gear teeth surfaces above its critical temperature to obtain an austenitic structure throughout its carburized surfaces; a first quenching expedient for cooling the workpiece at a rate greater than the critical cooling rate of its carburized case to a uniform metastable austenitic temperature just above the martensitic transformation temperature; opposed dies, each having an outer peripheral profiled surface, for rolling the gear teeth surfaces to a desired outer peripheral profiled shape while holding the temperature of the workpiece in the uniform metastable austenitic temperature range, the dies being operable such that the gear surfaces first undergo densification by rolling involving substantial compaction of the material in the gear tooth surface layers resulting in a collapse of the pores initially existing near the gear tooth surface region, then plastic deformation as a result of the rolling and sliding movements in the metastable austenitic temperature range with resultant strengthening of the gear teeth; and a second quenching expedient for cooling the workpiece through the martensitic range for hardening the carburized gear teeth surfaces.

The method and apparatus described by United States Patent Application Publication No. 2004/0219051 are limited to working only the outside diameter of a gear by a rolling gear die. The technique of United Stated Patent Application Publication No. 2004/0219051 A1 is not applicable to working the inside diameter of such a gear or to making parts other than those that can be made by rolling operations. It would, of course, be desirable to make high strength parts in addition to gears and to have the ability to work the inside diameter as well as the outside diameter of such a part.

SUMMARY OF THE INVENTION

The technique of this invention allows for metal parts to be strengthened while maintaining excellent tolerances with respect to the finished dimensions of the part. This technique can be utilized in manufacturing gears, cams, bearing races, bearing guides, parking gear guides, clutch races, and a variety of other types of parts. The technique of this invention is most valuable in manufacturing parts that will be heavily loaded during their service life that can be made by coining, drawing, or extrusion operations. One important benefit of utilizing the technique of this invention is that the part is strengthened with respect to both the surface on its outside diameter as well as the surface of its inside diameter (if applicable). For instance, this technique can be used to simultaneously strengthen both the gear teeth and the bore of a gear. It can also be used to simultaneously strengthen both the outside diameter as well as the surface of the inside diameter of a cam lobe.

In the practice of this invention a preformed metal part is heated to a temperature which is sufficient to transform the metal of the preformed part to the austenitic state. Then, the part is immersed in a heat transfer medium, such as an oil bath, with the heat transfer medium being maintained at a temperature which is within a range that allows for the metal of at least a portion of the part, usually its surface, to remain in a metastable austenitic state. The part is then coined, drawn, or extruded while it or at least the portion of the part being worked remains in the metastable austenitic state at a temperature near but above the $M_s$ temperature, usually in the range of 400 to 600° F. depending on the alloy composition. It is frequently convenient to maintain the part in the heat transfer medium through the coining, drawing, or extruding step of the procedure. However, in some cases it is more desirable to remove the part from the heat transfer medium shortly before it is coined, drawn, or extruded. After being coined, drawn, or extruded the part is quenched at a temperature that quickly transforms the metal in the part from the meta-stable austenitic state to martensite. This offers the advantage of the part exhibiting improved strength while maintaining the ability to achieve excellent tolerance, with respect to the desired dimensions of the part, as a result of needing to quenching from only 300 to 650° F. unlike conventional processing where by in the heat treating process the quench step is from 1200 to 1500° F. For purposes of this invention the term "coining" is a method of deformation whereby pressure is applied to the metal preform resulting in the metal of the preform flowing to meet the defined shape of the confining die and/or punches or core rod. The term coining is sometimes interchanged with the terms sizing, burnishing, cold heading or warm heading.

The preformed metal part can be manufactured by any metal working process including but not limited to heading, machining, hobbing, shaving, powder metallurgy, powder forging, forging or any other metal working process understood by any person skilled in the art. This invention results in improved dimensional control versus conventional processing in that in conventional processing the part is worked (machined, forged, etc.) prior to heat treating. This is in contrast to this invention wherein the working of the part is in the metastable austenitic state thus resulting in substantially less thermally induced deformation and subsequently results in much lower dimensional variation. This allows for attainment of much higher tolerances in the manufacture of precision components.

The maximum quench rate must be much less than the rate at which quench cracking occurs. This temperature can be determined by a person skilled in the art. The final quench can be atmosphere, air, water, or oil.

Flame impingement or high frequency induction for surface heating are alternatives to ausizing the entire part through heating using conventional oven to heat the part or induction heating.

The present invention more specifically discloses a process for strengthening and obtaining the desired dimensions for a metal part comprising: (1) heating at least a portion of a preformed metal part to a temperature above about 1300° F. to transform the metal in at least said portion of the part to an austenitic state to produce an austenitized preformed metal part, (2) quenching the austenitized preformed metal part to a temperature which is within the range of 300° F. to 650° F. to hold the metal in the preformed part in a metastable austenitic state, (3) coining, drawing or extruding the preformed metal part while said metal of said preformed metal part is maintained a temperature which is within the range of 300° F. to 650° F., and (4) quenching the coined metal part at a temperature which allows for the rapid transformation from metastable austenite to martensite.

DETAILED DESCRIPTION OF THE INVENTION

Figure 1:
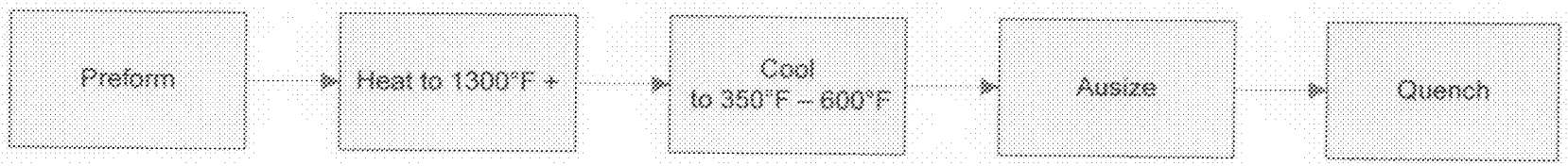
FIG. 1 is a flow chart illustrating the preferred embodiment of the invention.

The preformed metal parts used in the process of this invention are typically made by conventional powder metallurgy processes. Such articles are normally manufactured by placing a metal powder of various compositions into a mold. After the metal powder formulation is introduced into the mold the powder is compressed under high pressure, typically from 20 to 70 tons per inch (tsi). This compressed part or preform is then considered to be green or uncured. The green part is then cured or sintered by heating in a sintering furnace, such as an electric or gas-fired belt or batch sintering furnace, for a predetermined time at high temperature in an inert environment. Nitrogen, vacuum and Nobel gases, such as helium or argon, are examples of such inert protective environments. Metal powders can be sintered in the solid state with bonding by diffusion rather than melting and re-solidification. Also, sintering may result in a decrease in density depending on the composition and sintering temperature.

Typically, the sintering temperature utilized will be about 60% to about 90% of the melting point of the metal composition being employed. The sintering temperature will normally be in the range of 1500° F. (816° C.) to 2450° F. (1343° C.). The sintering temperature for iron based compacts will more typically be within the range of 2000° F. (1093° C.) to about 2400° F. (1316° C.). The sintering temperature utilized with copper systems will, of course, be considerably lower due to the lower melting point of copper. In any case, the appropriate sintering temperature and time-at-temperature will depend on several factors, including the chemistry of the metallurgical powder, the size and geometry of the compact, and the heating equipment used. Those of ordinary skill in the art may readily determine appropriate parameters for the molding steps to provide a green preform of suitable density and geometry which is then placed into a furnace at a temperature which is within the range of 2000° F. to 2450° F. for approximately 30 minutes in a protective atmosphere to sinter the metal. The final density of the part will vary widely depending on its composition and the particular pressing and sintering parameters employed. The average density of a green preform formed from an iron-base metallurgical powder typically is in the range of 6.2 to 7.2 g/cc and may be, for example, 6.8 g/cc.

The metal powders that can be utilized in manufacturing powder metal parts are typically a substantially homogenous powder including a single alloyed or unalloyed metal powder or a blend of one or more such powders and, optionally, other metallurgical and non-metallurgical additives such as, for example, lubricants. Thus, "metallurgical powder" may refer to a single powder or to a powder blend. There are three common types of powders used to make powder metal mixes and parts. The most common are homogeneous elemental powders such as iron, copper, nickel and molybdenum. These are blended together, along with additives such as lubricants and graphite, and molded as a mixture. A second possibility is to use pre-alloyed powders, such as an iron-nickel-molybdenum steel. In this case, the alloy is formed in the melt prior to atomization and each powder particle is a small ingot having the same composition as the melt. Again, additives of graphite, lubricant and elemental powders may be added to make the mix. A third type is known as "diffusion bonded" powders. In this case, an elemental powder, such as iron, is mixed with a second elemental powder or oxide of a powder, and is subsequently sintered at low temperatures so partial diffusion of the powders occurs. This yields a powder with fairly good compressibility which shows little tendency to separate during processing. While iron is the most common metal powder, powders of other metals such as aluminum, copper, tungsten, molybdenum and the like may also be used. Also, as used herein, an "iron metal powder" is a powder in which the total weight of iron and iron alloy powder is at least 50 percent of the powder's total weight. While more than 50% of the part's composition is iron, the powder may include other elements such as carbon, sulfur, phosphorus, manganese, molybdenum, nickel, silicon, chromium, and copper.

At least four types of metallic iron powders are available for utilization in powder metallurgy. These metallic iron powders include: electrolytic iron, sponge iron, carbonyl iron and nanoparticle sized iron and are made by a number of processes. Electrolytic iron is made via the electrolysis of iron oxide, and is available in annealed and unannealed form from, for example, OM Group, Inc., which is now owned by North American Höganäs, Inc. Sponge iron is also available from North American Höganäs, Inc. There are at least two types of sponge iron: hydrogen-reduced sponge iron and carbon monoxide-reduced sponge iron. Carbonyl iron powder is commercially available from Reade Advanced Materials. It is manufactured using a carbonyl decomposition process.

Depending upon the type of iron selected, the particles may vary widely in purity, surface area, and particle shape. The following non-limiting examples of typical characteristics are included herein to exemplify the variation that may be encountered. Electrolytic iron is known for its high purity and high surface area. The particles are dendritic. Carbonyl iron particles are substantially uniform spheres, and may have a purity of up to about 99.5 percent. Carbon monoxide-reduced sponge iron typically has a surface area of about 95 square meters per kilogram ($m^2$/kg), while hydrogen-reduced sponge iron typically has a surface area of about 200 $m^2$/kg. Sponge iron may contain small amounts of other elements, for example, carbon, sulfur, phosphorus, silicon, magnesium, aluminum, titanium, vanadium, manganese, calcium, zinc, nickel, cobalt, chromium, and copper. Additional additives may also be used in molding the part.

The method of this invention relates to low-to-medium carbon and low-to-medium alloyed sintered powder metal steels that are heat treated by carburizing to increase the surface and near surface carbon content and then hardened. The invention is also applicable to medium-to-high carbon and low-to-medium alloyed sintered powder metal steels that do not require the carburizing operation but only require the hardening operation. More specifically, the method and apparatus of the invention are applicable to powder metal parts that are produced by a variety of powder metal processing techniques for pressing, sintering, densification and/or hardening such as (a) single or multiple-pressing operations, (b) single and multiple sintering operations, (c) integrated sintering and hardening, (d) integrated sintering, carburizing and hardening, (e) forged powder metal part blanks fabricated by any of the above-mentioned processing techniques, (f) surface densified gear blanks as described by U.S. Pat. No. 5,711,187, and (g) fully densified part blanks (such as, forged powder metal heel blanks).

Figure 2:
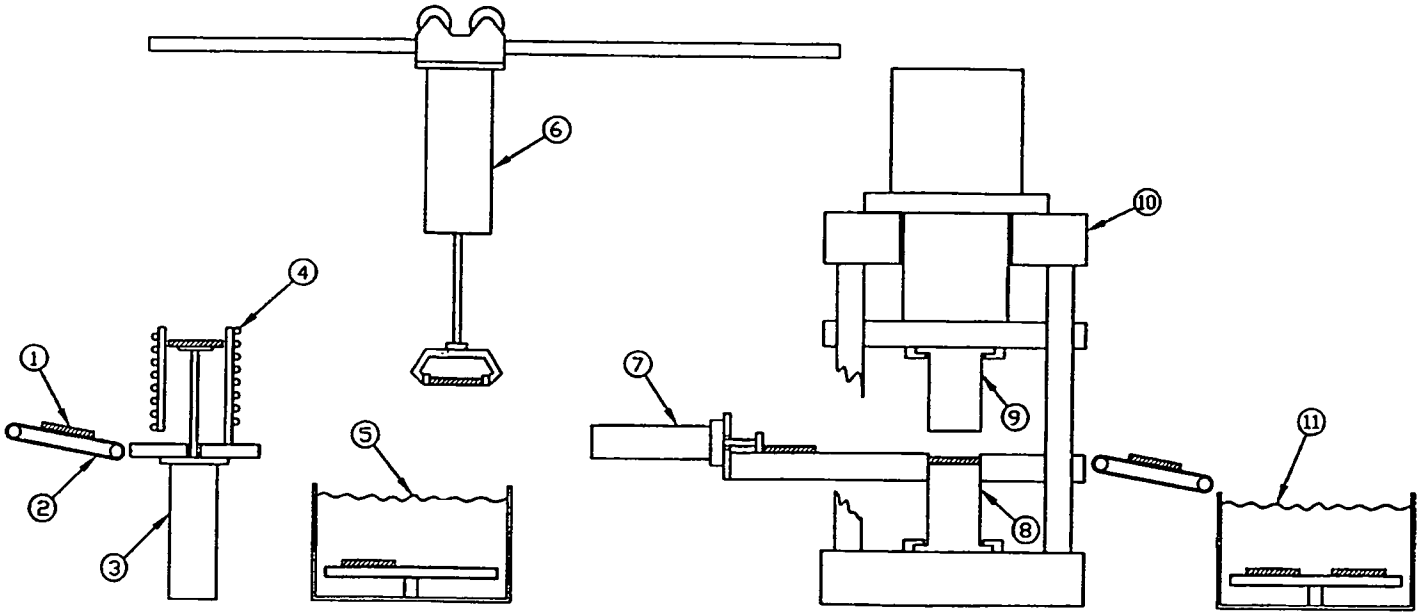
FIG. 2 is a side elevation view diagrammatically illustrating one method of the invention for performing precision finishing of metal performs.
Figure 3:
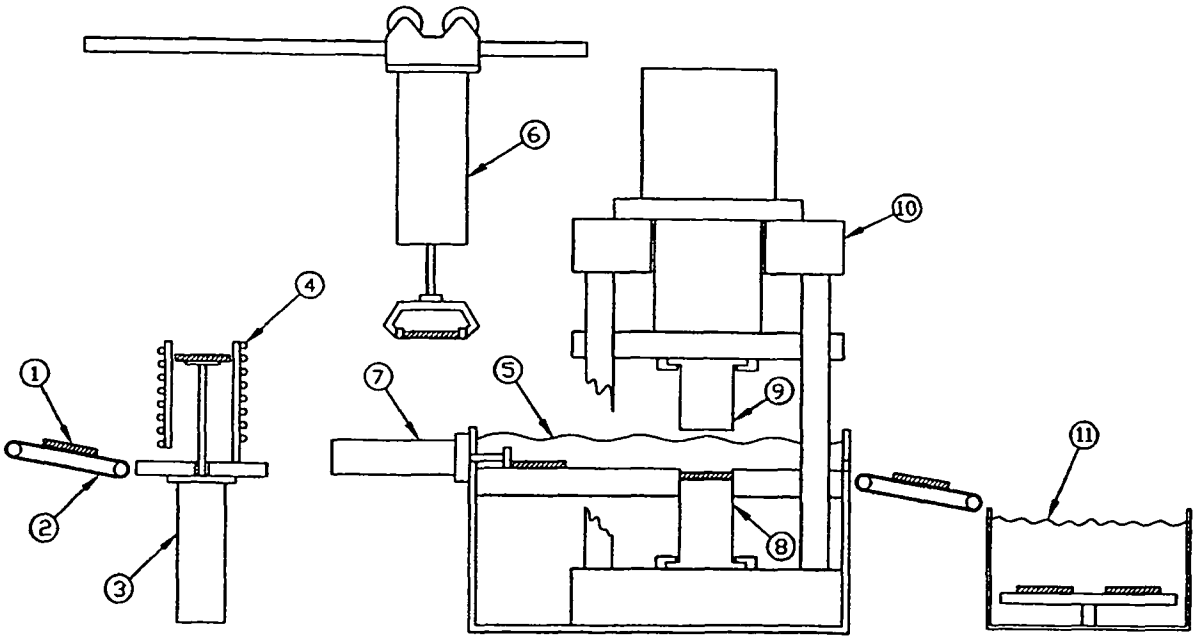
FIG. 3 is a side elevation view diagrammatically illustrating a second method of the invention for performing precision finishing of metal performs.

FIG. 2 illustrates a preferred embodiment of the invention. In the first step of the process of this invention a preformed metal part 1 that is typically made by powder metallurgy is fed 2,3 through a heating apparatus 4 which heats the preformed metal part to a temperature that is sufficient to produce austenite in at least of portion of the part. This is accomplished by heating at least a portion of the part to a temperature above about 1300° F. However, it is important for austenite to be formed in the portions of the part that will subsequently be worked by coining, drawing or extruding. Typically, at least the surface of the part will be heated to the elevated temperature at which austenite is formed. The metal of that portion of the part will typically be heated to a temperature of at least 1400° F. and will more typically be heated to a temperature of at least 1500° F. to insure the formation of austenite. It is frequently preferred for at least a portion of the part to be heated to a temperature which is within the range of 1900° F. to 2100° F. in step (1) to insure that the preformed part is totally austenitized.

In the second step of the process of this invention the austenitized part transferred 6 to a quenching media 5 where the preformed metal part is quenched by cooling it to a temperature which is within the range of 300° F. to 650° F. In any case, the part will be cooled to the degree necessary to place it in the metastable austenitic state. This can be done in accordance with the procedure described by United States Patent Application Publication No. 2004/0219051 A1. The teachings of United States Patent Application Publication No. 2004/0219051 A1 are incorporated herein by reference.

The austenitized part is normally quenched in step (2) by placing it in a heat transfer medium, such as a standard marquenching oil, that is held at a temperature within the range of 300° F. to 650° F. The heat transfer medium will typically be maintained at a temperature which is within the range of 325° F. to 500° F. The heat transfer medium will more typically be held at a temperature which is within the range of 350° F. to 450° F. It is frequently preferred for the heat transfer medium to be held at a temperature which is within the range of 360° F. to 425° F.

In the third step of the process of this invention the preformed metal part fed 7 into an apparatus 10, such as but not limited to a hydraulic press, where the preformed metal part is coined, drawn or extruded while it is maintained in the metastable austenitic state. It should be understood that it is only necessary for the portions of the part that are actually being worked by coining, drawing, or extrusion to actually be in the metastable austenitic state. In other words, the metal in interior sections of the part not being worked need not be in the metastable austenitic state. It is frequently convenient for the part to be held in the heat transfer medium until it is coined, drawn, or extruded to reliably maintain it in the metastable austenitic state. However, in some cases it is desirable for the part to be removed from the heat transfer medium shortly before being worked. However, the time period must be short enough for the part (or at least the critical portion of it) to still be in the metastable austenitic state. In such cases it is desirable for the part to be coined, drawn, or extruded within a few seconds after being removed from the heat transfer medium. Typically, the part will be coined, drawn, or extruded within about 3 seconds after being removed from the heat transfer medium.

After being coined, drawn, or extruded the part is transferred to a quench media 11 where the coined, drawn or extruded part is quenched at a temperature that allows for rapid transformation from austenite to martensite. This can be conveniently accomplished by subjecting the part to a pressurized gas stream. However, a liquid heat transfer medium can also be used for this purpose. In any case, the part will typically be cooled in this final quenching step at a rate of at least 3° F. per second, preferably at least 10° F. per second, and most preferably at least 20° F. per second.

While certain representative embodiments and details have been shown for the purpose of illustrating the subject invention, it will be apparent to those skilled in this art that various changes and modifications can be made therein without departing from the scope of the subject invention.

What is claimed is:

1. A process for strengthening and obtaining the desired dimensions for a metal part comprising: (1) heating at least a portion of a preformed metal part to a temperature above about 1300° F. to transform the metal in at least said portion of the part to an austenitic state to produce an austenitized preformed metal part, (2) quenching the austenitized preformed metal part to a temperature which is within the range of 300° F. to 650° F. to put the metal in the preformed part in a metastable austenitic state, (3) coining the preformed metal part by applying a sufficient pressure to the preformed metal part to cause the metal of the preformed metal part to flow to meet the defining shape of a die while said metal of said preformed metal part is maintained in the metastable austenitic state at a temperature which is within the range of 300° F. to 650° F., and (4) quenching the coined metal part by cooling the coined metal part at a temperature which provides for a cooling rate of at least 3° F. per second and which allows for the rapid transformation from meta-stable austenite to martensite.

2. A process as specified in claim 1 wherein the preformed metal part is heated in step (1) to a temperature of at least 2000° F.

3. A process as specified in claim 1 wherein the preformed metal part is heated in step (1) to a temperature within the range of 1900° F. to 2100° F.

4. A process as specified in claim 1 wherein the austenitized preformed metal part is quenched in step (2) at a temperature which is within the range of 350° F. to 450° F.

5. A process as specified in claim 1 wherein the austenitized preformed metal part is quenched in step (2) at a temperature which is within the range of 360° F. to 425° F.

6. A process as specified in claim 1 wherein the coined metal part is quenched in step (4) by immersing the metal part in a heat transfer medium which is maintained at a temperature which is within the range of 100° F. to 200° F.

7. A process as specified in claim 1 wherein the coined metal part is cooled in step (4) at a cooling rate of at least 10° F. per second.

8. A process as specified in claim 1 wherein the coined metal part is cooled in step (4) at a cooling rate of at least 20° F. per second.

9. A process as specified in claim 1 wherein the austenitized preformed metal part is quenched in step (2) by placing it in a heat transfer medium which is maintained at a temperature within the range of 350° F. to 650° F.

10. A process as specified in claim 9 wherein the heat transfer medium is an oil bath.

11. A process as specified in claim 9 wherein the part is coined in step (3) while being maintained in the heat transfer medium.

12. A process as specified in claim 9 wherein the part is coined in step (3) after being withdrawn from the heat transfer medium.

* * * * *